United States Patent [19]

Ohe et al.

[11] Patent Number: 4,823,141

[45] Date of Patent: Apr. 18, 1989

[54] VEHICLE ANTENNA SYSTEM

[75] Inventors: Junzo Ohe, Toyota; Hiroshi Kondo, Okazaki, both of Japan

[73] Assignee: Toyota Jidosha Kabushiki Kaisha, Toyota, Japan

[21] Appl. No.: 893,875

[22] Filed: Aug. 6, 1986

[30] Foreign Application Priority Data

Aug. 9, 1985 [JP] Japan ..... 60-175221

[51] Int. Cl.[4] ..... H01Q 1/32

[52] U.S. Cl. ..... 343/713; 343/712; 343/866; 343/741; 343/748

[58] Field of Search ..... 343/711, 712, 713, 866, 343/748, 741

[56] References Cited

U.S. PATENT DOCUMENTS

| | | | |
|---|---|---|---|
| 2,520,986 | 9/1950 | Williams et al. | 343/712 |
| 2,575,471 | 11/1951 | Schweiss et al. | 343/712 |
| 3,210,766 | 10/1965 | Parker | 343/712 |
| 3,717,876 | 2/1973 | Volkers et al. | 343/788 |
| 3,794,997 | 2/1974 | Jwatsuki et al. | 343/712 |
| 3,961,330 | 6/1976 | Davis | 343/748 |
| 3,972,048 | 7/1976 | Davis | 343/712 |
| 4,080,603 | 3/1978 | Moody | 343/712 |
| 4,717,921 | 1/1988 | Ohe et al. | 343/712 |

FOREIGN PATENT DOCUMENTS

| | | | |
|---|---|---|---|
| 53-34826 | 8/1978 | Japan . | |
| 0172804 | 6/1985 | Japan | 343/713 |

*Primary Examiner*—William L. Sikes
*Assistant Examiner*—Hoanganh Le
*Attorney, Agent, or Firm*—Cushman, Darby & Cushman

[57] ABSTRACT

The present invention provides a vehicle antenna system for detecting broadcast waves received by the vehicle body and then transmitting detected signals to various onboard receivers. The vehicle antenna system includes a loop antenna longitudinally disposed in close proximity to a marginal edge on the vehicle body to detect high frequency surface currents induced on the vehicle body by broadcast waves, the loop antenna being connected in series with a capacitor to form a series resonance circuit for causing a resonation with frequencies belonging to an increased range of bands and particularly to FM or higher frequency bands to provide an improved sensitivity on reception.

5 Claims, 4 Drawing Sheets

VEHICLE ANTENNA SYSTEM

BACKGROUND OF THE INVENTION

1. Field of the Invention

The present invention relates to an improved vehicle antenna system which can efficiently detect broadcast waves received by the vehicle body and transmit them to various onboard receivers.

2. Description of the Prior Art

With modern automobiles, antenna systems are essential for positively receiving broadcast and/or communication waves at various onboard receivers such as radios, TV's, car-telephones and others. Antenna systems also have an important role in citizen band tranceivers as providing a communication between an automobile and the other stationary or movable station. In future, such vehicle antenna system will increasingly be important for vehicles standardized with various receivers.

A pole type antenna is known as one of the conventional vehicle antenna systems. The pole antenna projects exteriorly from the vehicle body and exhibits a favorable performance of reception in its own way. However, the pole antenna was always an obstruction in the designs of the vehicle body.

The pole antenna also is disadvantageous in that it may accidentally or intentionally be subjected to damage and in that the pole antenna may produce unpleasant noises during running at high speeds. Therefore, it was very advantageous to eliminate the pole antenna from the vehicle body.

Recently, the number of frequency bands for broadcast or communication waves to be received by automobiles are being increased. If a plurality of pole antennas are located on a vehicle body matching the increased number of broadcast waves to be received, they would severly damage the aesthetic concept of the vehicle appearance. Furthermore, there will be created electrical interference between the pole antennas, thereby remarkably degrading the reception performance.

Some attempts have been made to eliminate or conceal pole antennas. One such attempt is application of an antenna wire to a rear window glass on a vehicle body.

Another attempt is to detect surface currents which are induced on the vehicle body by broadcast waves. Although this was considered to be the most positive and efficient means, experiments have showed that the detection of surface currents on the vehicle body is not so advantageous as expected.

The first reason is that the level of surface currents is not so high as expected. The prior art attempted mainly to detect surface currents flowing on the roof panel of the vehicle body. However, the level of surface currents is insufficient for the surface currents to be utilized as output signals of the antenna system.

The second reason is that the surface currents will contain noise signals at a very high rate. Such noise signals are produced at engine ignition systems and battery charging regulators. Therefore, such noise signals cannot be eliminated when the engine is running.

Even under such disadvantageous situations, some proposals have been made to utilize surface currents induced on the vehicle body by broadcast waves. For example, Japanese Patent Publication Sho No. 53-22418 discloses one such proposal wherein electric insulation is formed on the vehicle body at a location in which surface currents flow concentrically. Currents flowing between the opposite ends of the electric insulation are detected by a sensor. Although such a proposal provides practicable detection signals which are superior in S/N ratio, it requires a pickup construction which is not applicable to normal mass production for some reasons such as the provision of notch on a portion of the vehicle body and so on.

Japanese Utility Model Publication Sho. No. 53-34826 discloses another proposal providing an antenna system which comprises a pickup coil for detecting currents on a pillar of the vehicle body. This proposal is advantageous in that the antenna system can completely be housed within the vehicle body. However, it is not practical to provide the pickup coil disposed near the pillar and extending perpendicular to the length thereof. In addition, such pickup arrangement cannot obtain practicable antenna outputs and appears to be only an idea.

Thus, the prior art antenna system for detecting surface currents induced on the vehicle body by broadcast waves were not necessarily successful. Particularly, the prior art does not solve problems associated with the pickup construction for efficiently detecting surface currents induced on the vehicle body by broadcast waves and the pickup arrangement for obtaining practicable S/N ratios.

In addition, the prior art antenna systems of the pickup type had reduced sensitivities of reception and particularly irregular sensitivities different from one frequency band to another.

SUMMARY OF THE INVENTION

It is therefore an object of the present invention to provide a vehicle antenna system which can effeciently detect surface currents induced on the vehicle body by broadcast waves through an increased range of frequency bands and transmit the detected signals to an onboard receiver means.

To this end, the present invention provides a vehicle antenna system comprising a high frequency pickup disposed in close proximity to a marginal portion on the vehicle body, said high frequency pickup capable of detecting high frequency surface currents having a frequency equal to or higher than a predetermined level, said high frequency pickup including a loop antenna opposed to the marginal portion of the vehicle body, said loop antenna being connected in series with a capacitor.

In such an arrangement, a series resonance circuit is defined by the loop antenna and the capacitor. The series resonance circuit causes a resonation with frequencies through an increased range of bands such that the reception can be provided at higher sensitivities.

The prior art antenna systems mainly intended to receive AM waves which were popular at one time. Since AM waves have large wavelengths, the prior art antenna systems could not receive the AM waves with good sensitivity. The inventors aimed at such a dependency of frequency and intended to provide an antenna system which exclusively receives broadcast waves belonging to FM or higher frequency bands normally equal to or higher than 50 MHz. Thus, the present invention provides a vehicle antenna system which can very efficiently receive broadcast waves by detecting surface currents on the vehicle body, as otherwise considered impossible in the prior art.

DETAILED DESCRIPTION OF PREFERRED EMBODIMENT

Figure 6:
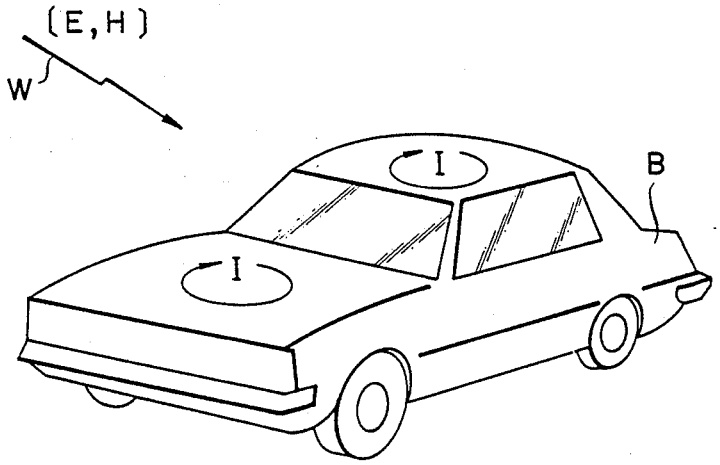
FIG. 6 illustrates surface currents I induced on the vehicle body B by external waves W.

Referring first to FIG. 6, there are shown surface currents I induced on the vehicle body B of conductive metal material at various locations by external waves W such as broadcast waves when they pass through the vehicle body B. The present invention intends to receive only waves belonging to relatively high frequency bands equal to or higher than 50 MHz, for example, FM waves, TV waves and so on.

The present invention is characterized by measuring the organic distribution of currents for such particular high frequency bands and providing a pickup disposed on the vehicle body at a location whereat the density of surface currents becomes higher with less noise.

The distribution of surface currents on the vehicle body can be determined by the use of a computer simulation and also by actually measuring the intensity of surface currents at various locations on the vehicle body. The present invention utilizes a probe constructed in accordance with the same principle as that of the high frequency pickup which will be described in more details. The probe is moved along the surface of the vehicle body while changing its orientation at each of the locations.

Figure 7:
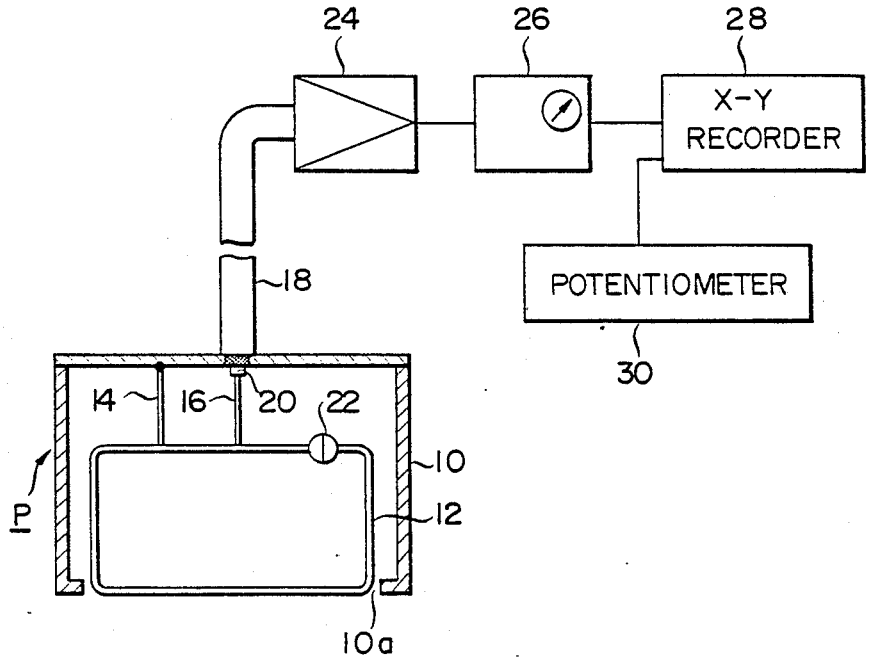
FIG. 7 illustrates a probe and its processing circuit for determining the distribution of surface currents, the probe being constructed in accordance with the same principle as that of the high frequency pickup according to the present invention.

FIG. 7 illustrates the construction of such a probe P which comprises a casing 10 of conductive material for avoiding the penetration of external waves and a loop coil 12 housed within the casing 10. The casing 10 is provided with an opening 10a through which a portion of the loop coil 12 is externally exposed. The exposed portion of the loop coil 12 is disposed in close proximity to the surface of the vehicle body B such that the loop coil 12 can detect a magnetic flux created by the surface currents on the vehicle body. The loop coil 12 is electrically connected with the casing 10 through a short-circuiting line 14. The output terminal 16 of the loop coil 12 is electrically connected with a core 20 in a coaxial cable 18. The loop coil 12 further includes a capacitor 22 electrically connected therewith. The capacitor 22 serves to cause the frequency of the loop coil 12 to resonate with a desired frequency to be measured. As a result, the efficiency of the pickup can be improved.

When such a probe P is moved along the surface of the vehicle body B while being angularly rotated at each of the locations, the distribution and orientation of surface currents on the vehicle body can accurately be measured.

Referring to FIG. 7, the output of the probe P is amplified by a high frequency voltage amplifier 24 the output of which in turn is measured at a high frequency voltage meter 26. At the same time, the output voltage of the coil is recorded by an XY recorder 28 as a value at each of the locations on the vehicle body. The XY recorder 28 also receives a signal indicative of that location from a potentiometer 30 such that the level of high frequency surface currents can be determined at that location of the vehicle body.

Figure 1:
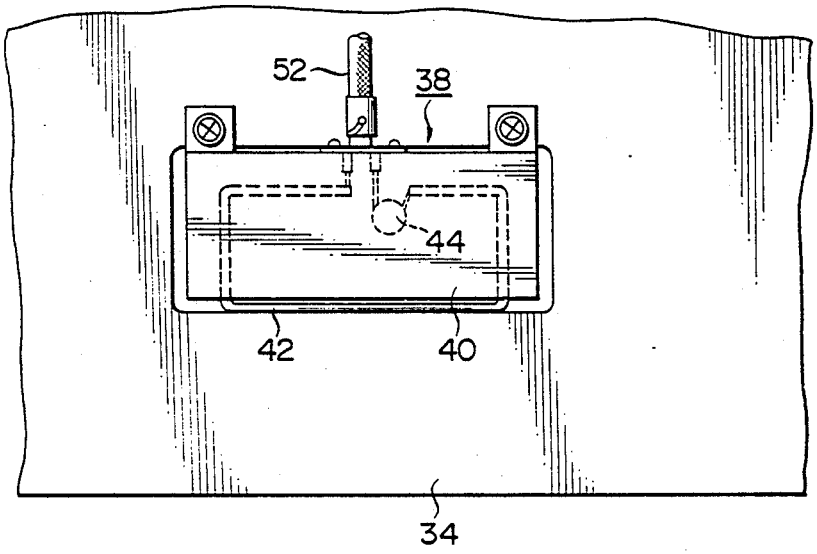
FIG. 1 is a plan view of a high frequency pickup mounted on the vehicle body.
Figure 2:
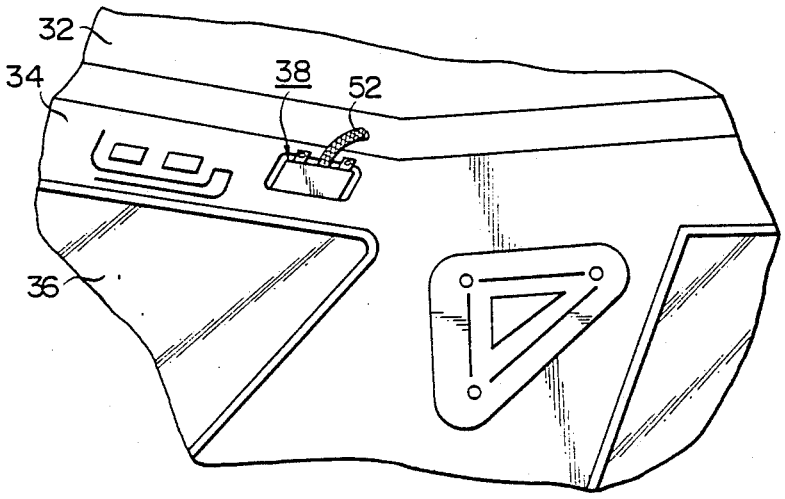
FIG. 2 is a perspective view of an electromagnetic coupling type high frequency pickup mounted on the rear window frame of the vehicle roof panel.

FIGS. 1 and 2 illustrate the high frequency pickup disposed in close proximity to the rearward portion of the roof panel.

In FIG. 2, there is shown a naked roof panel 32 of metal material which is connected with the rear window glass 36 through a rear window frame 34 serving as a marginal terminal for the roof panel 32.

In the illustrated embodiment, the high frequency pickup 38 is disposed spaced from the marginal edge of the rear window frame 34 within a range represented by:

$$1 = 12 \times 10^{-3\lambda}$$

where $\lambda$ is the wavelength of broadcast waves to be received.

The present invention is characterized by that the high frequency pickup 38 is in the form of an electromagnetic coupling type pickup comprising a casing 40 of plastic material and a loop antenna 42 housed within the casing 40, the loop antenna 42 being electrically connected in series with a capacitor 44.

Figure 3:
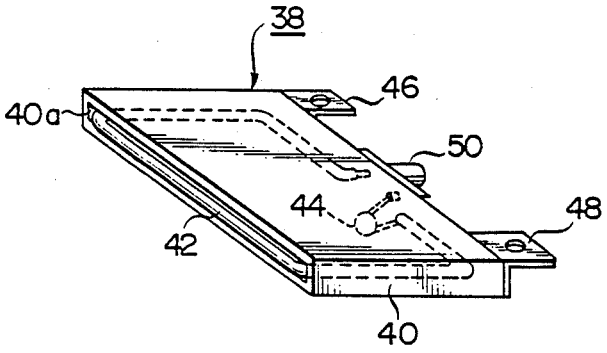
FIG. 3 is a perspective view of the high frequency pickup.

As shown in FIG. 3, a portion of the loop antenna 42 is externally exposed through a slit 40a formed in the casing 40 at one edge such that an external flux can efficiently be detected by the loop antenna 42.

Signals detected by the loop antenna 42 are taken out through a coaxial cable 52 via a BNC connector 50 and then transferred to various onboard receivers such as radio, TV and other receivers.

The casing 40 of the high frequency pickup 38 includes L-shaped brackets 46 and 48 at the opposite ends thereof. The brackets 46 and 48 are used to positively position and mount the casing 40 on the marginal portion of the vehicle body.

The loop antenna 42 is in the form of a single winding antenna which is electrically insulated such that the antenna can be located in intimate contact with the rear window frame 34. Thus, the loop antenna 42 can more intensively intersect a magnetic flux created by the surface currents on the vehicle body.

Figure 4:
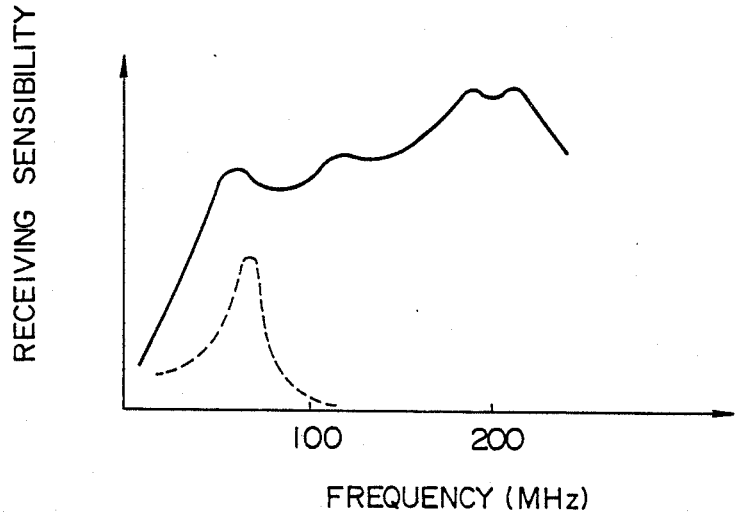
FIG. 4 is a graph showing the relationship between the frequency bands and the level of reception in the vehicle antenna system according to the present invention.

FIG. 4 illustrates the characteristics of reception in antenna systems in which solid line represents the characteristics of reception in the antenna system according to the present invention while broken line shows the characteristics of reception in a conventional parallel resonance type pickup. As will be apparent from this figure, the characteristics of reception in the antenna system according to the present invention can cover an increased range of bands with an improved sensitivity in comparison with those of the parallel resonance type pickup.

If the inductance of the loop antenna 42 is equal to about 50–100 nH and the capacitor is equal to 0.5–3 pF, the antenna system having the above arrangement can easily receive waves belonging to FM-TV frequency bands, that is, a range of frequency equal to 76–220 MHz in Japan without need of any external control.

Another feature of the present invention is that the high frequency pickup 38 is reduced in thickness since it is made of only the loop antenna 42. To this end, the small-sized BNC connector 50 is utilized to connect the antenna system with the coaxial cable 52. As a result, the total size of the antenna system can be reduced.

Figure 5:
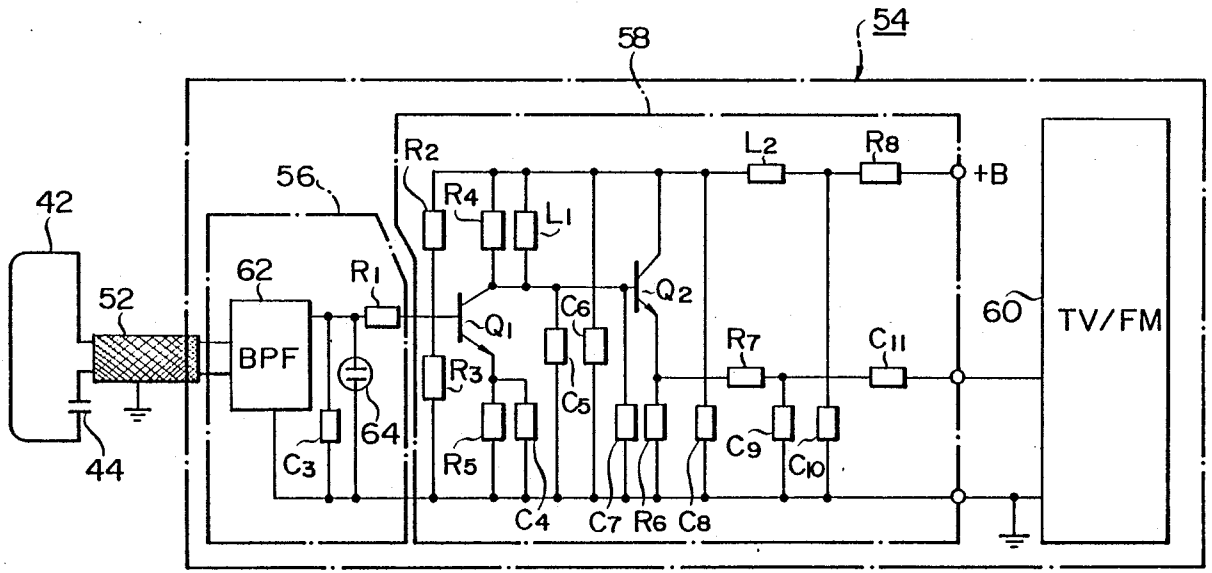
FIG. 5 is a circuit diagram of the vehicle antenna system according to the present invention.

FIG. 5 shows a concrete circuit used in the illustrated antenna system, which will be described below with reference to both the connection and function thereof.

The outer conductive sheath of the coaxial cable 52 is grounded. Signals detected by the loop antenna 42 are transferred to a receiver 54 through the coaxial cable 52. The receiver 54 includes an impedance matching circuit 56, an amplifying circuit 58 and an output selecting circuit 60.

The impedance matching circuit 56 includes a band pass filter 62 and a discharge tube 64. The voltage of the capacitor 44 obtained from the loop antenna 42 is applied to the input of the band pass filter 62 the output of which in turn is connected with a parallel circuit consisting of the discharge tube 64 and a capacitor $C_3$. The discharge tube 64 functions to protect the circuit from electrostatic breakage due to static electricity, thunderbolt and so on.

The band pass filter 62 provides an impedance matching with the loop antenna 42. Signals subjected to such an impedance matching are amplified by the high frequency amplifying circuit 58.

The amplifying circuit 58 includes two-stage connected transistors $Q_1$ and $Q_2$ the outputs of which are supplied to the output selecting circuit 60 to generate voice outputs and others.

In FIG. 5, inductance $L_1$ and $L_2$ are peaking coils; resistors $R_2$ and $R_3$ are to stabilize the transistor $Q_1$; $R_5$ and $R_6$ denote bias resistors; and $C_3$ and $C_9$ designate bypass capacitors.

In such a manner, the present invention provides the desired impedance matching and high frequency amplifying process for feeble signals detected by the loop antenna 42 such that waves belonging to an increased range of bands including FM or TV bands can more sensitively be received by the antenna system.

We claim:

1. An automobile antenna for use on a vehicle body, said system comprising:

high frequency pick up means for detecting high-frequency surface currents induced on the vehicle body, by broadcast waves, and concentrated on a marginal edge portion of a rear window frame of the vehicle body, said high frequency pick up means comprising an insulated loop antenna connected in series with a fixed capacitor; and casing means made of plastic and provided for housing said high frequency pick up means, said casing means having a slotted opening on one side through which only one longitudinal side of the loop antenna extends and having mounting brackets for being mounted in an opening in the rear window frame so that the one longitudinal side of the insulated loop antenna extending through the slotted opening in said casing means contacts with the marginal edge portion of the rear window frame of the vehicle body.

2. A vehicle antenna system as defined in claim 1 said loop antenna and said fixed capacitor forming a series resonance circuit for receiving broadcast waves belonging to FM or higher frequency bands.

3. A vehicle antenna system as defined in claim 1 said loop antenna having its inductance equal to about 50 to 100 nH and said fixed capacitor being set at 0.5 to 3 pF, whereby broadcast waves belonging to FM and TV frequency bands are received by said antenna system.

4. A vehicle antenna system as defined in claim 1, said opening in the rear window frame and said high frequency pickup means being disposed spaced from the marginal edge portion of the rear window frame of the vehicle body within a range represented by:

$$12\times10^{-3\lambda}$$

where $\lambda$ is the wavelength of broadcast waves to be received.

5. A vehicle antenna system as defined in claim 1 wherein signals detected by said loop antenna are transferred to a receiver through a coaxial cable having its outer conductive sheath connected with the earth.

* * * * *